US010760411B2

(12) United States Patent
Robey et al.

(10) Patent No.: US 10,760,411 B2
(45) Date of Patent: Sep. 1, 2020

(54) PASSIVE WELLBORE MONITORING WITH TRACERS

(71) Applicant: HALLIBURTON ENERGY SERVICES, INC., Houston, TX (US)

(72) Inventors: Richard E. Robey, Mansfield, TX (US); Justin L. Mason, Denton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/638,022

(22) PCT Filed: Sep. 27, 2017

(86) PCT No.: PCT/US2017/053758

§ 371 (c)(1),
(2) Date: Feb. 10, 2020

(87) PCT Pub. No.: WO2019/066811

PCT Pub. Date: Apr. 4, 2019

(65) Prior Publication Data

US 2020/0217190 A1 Jul. 9, 2020

(51) Int. Cl.
*E21B 47/11* (2012.01)
*E21B 43/116* (2006.01)

(52) U.S. Cl.
CPC ..... *E21B 47/11* (2020.05); *E21B 43/116* (2013.01)

(58) Field of Classification Search
CPC ..... E21B 47/11; E21B 43/116
See application file for complete search history.

(56) References Cited

U.S. PATENT DOCUMENTS 5,626,193 A 5/1997 Nzekwu et al.
6,564,866 B2 * 5/2003 Clark ..... E21B 43/11857 166/250.12

(Continued)

FOREIGN PATENT DOCUMENTS

WO 2017074364 A1 5/2017

OTHER PUBLICATIONS

Mjaaland, Svein et al.; "Wireless inflow monitoring in a subsea field development: A case study form hyme field, offshore mid-norway," SPE-170619-MS; Society of Petroleum Engineers; 2014.

(Continued)

*Primary Examiner* — Silvana C Runyan
(74) *Attorney, Agent, or Firm* — Polsinelli PC

(57) ABSTRACT

A method involving introducing a perforation string into a wellbore passing through a subterranean formation, the perforation string having a perforation gun and a releasable tracer, the releasable tracer being releasable in response to a fluid produced from the subterranean formation contacting the nearby perforation string. The method includes perforating, with the perforation gun, a surface of the wellbore and withdrawing fluid from a wellbore. The method further includes allowing the releasable tracer to release from the perforation string after the fluid produced from the formation contacts the perforation string and flows toward an entrance of the wellbore. Finally, measuring at least one of an amount or presence of the releasable tracer thereby indicating at least one of an amount or presence of the fluid produced from the subterranean formation.

20 Claims, 3 Drawing Sheets

(56) References Cited

U.S. PATENT DOCUMENTS

| | | | | |
|---|---|---|---|---|
| 2009/0025470 | A1* | 1/2009 | Green | E21B 43/117 73/152.18 |
| 2010/0147587 | A1* | 6/2010 | Henderson | E21B 43/117 175/2 |
| 2012/0175109 | A1 | 7/2012 | Richard | |
| 2013/0091943 | A1 | 4/2013 | Skillingstad | |
| 2016/0298412 | A1 | 10/2016 | Fripp et al. | |
| 2016/0319659 | A1 | 11/2016 | Molenaar et al. | |
| 2019/0100973 | A1* | 4/2019 | Lauritzen | E21B 23/01 |

OTHER PUBLICATIONS

International Search Report and Written Opinion; PCT Application No. PCT/2017/053758; dated Jun. 22, 2018.

* cited by examiner

Oil or Gas
Water
Oil or Gas Tracer
Water (PPT) Tracer
Water (PPT)
0
t 110
112
115
120
121
122
123
125
126
130
135
140
145
150
155
160
165
170
100

PASSIVE WELLBORE MONITORING WITH TRACERS

CROSS-REFERENCE TO RELATED APPLICATIONS

This application is a national stage entry of PCT/US2017/053758 filed Sep. 27, 2017, said application is expressly incorporated herein in its entirety.

The present disclosure relates to wellbore monitoring, and in particular monitoring the composition and quality of the fluids produced from a wellbore. More particularly the present disclosure relates to tracers for monitoring and detecting produced wellbores fluids.

BACKGROUND

Wells vary in the quality of the produced hydrocarbon fluid over their lifespan. In order to establish hydrocarbon producing wells, first, drilling is conducted to generate wellbores passing through subterranean formations which may have hydrocarbon reservoirs. After drilling the wellbore, perforation and fracturing processes may then be conducted. During the perforation phase, a perforation gun may be introduced downhole and activated to penetrate and form perforations in the side of the wellbore. The perforations extend and form holes a distance into the surrounding hydrocarbon containing formation. Fracturing processes may optionally then take place to lengthen or widen the perforations to improve hydrocarbon flow.

Hydrocarbons can be recovered via their own natural drive mechanisms which can have a multitude of sources, such as a pressurized gas cap under a cap rock, or a bottomwater drive. Natural drive reservoirs may be enhanced with other enhancement operations, however some reservoirs require enhanced operations to be economical. A popular enhanced recovery method is hydraulic fracturing. After fracturing or any other enhanced recovery operation (steam injection, water flooding, $CO_2$ injection, acidizing, etc.), production processes may be conducted. Production equipment can be placed downhole to withdraw hydrocarbons from the reservoir. Hydrocarbons can be produced in this way for long periods of time, for example many years. As time goes on, the fraction of hydrocarbon may decrease and water fraction increase, thereby decreasing the efficiency of the produced wellbore. This percentage or ratio is typically referred to as water cut or water oil ratio (WOR). This phenomenon is sometimes referred to a coning, which can consist of any of the following: production of water in an oilwell with a bottom water natural drive, production of gas in an oilwell with a gas cap natural drive, and production of water in a gas well. Coning is a rate sensitive problem, meaning wells flowing at high rates are subjected to the migration of less desirable drive fluids/gases. To optimize well production, a well could be flowed at its maximum flow rate just below where the migrations take hold. Accordingly wellbores are evaluated and monitored to assure optimal production and use over their lifetime. Depending on results of monitoring, additional processes such as an intervention or flow rate adjustments can be carried out to improve production, or alternatively, the wellbore can be closed.

BRIEF DESCRIPTION OF THE DRAWINGS

Implementations of the present technology will now be described, by way of example only, with reference to the attached figures, wherein.

DETAILED DESCRIPTION

Figures 1A, 1B:
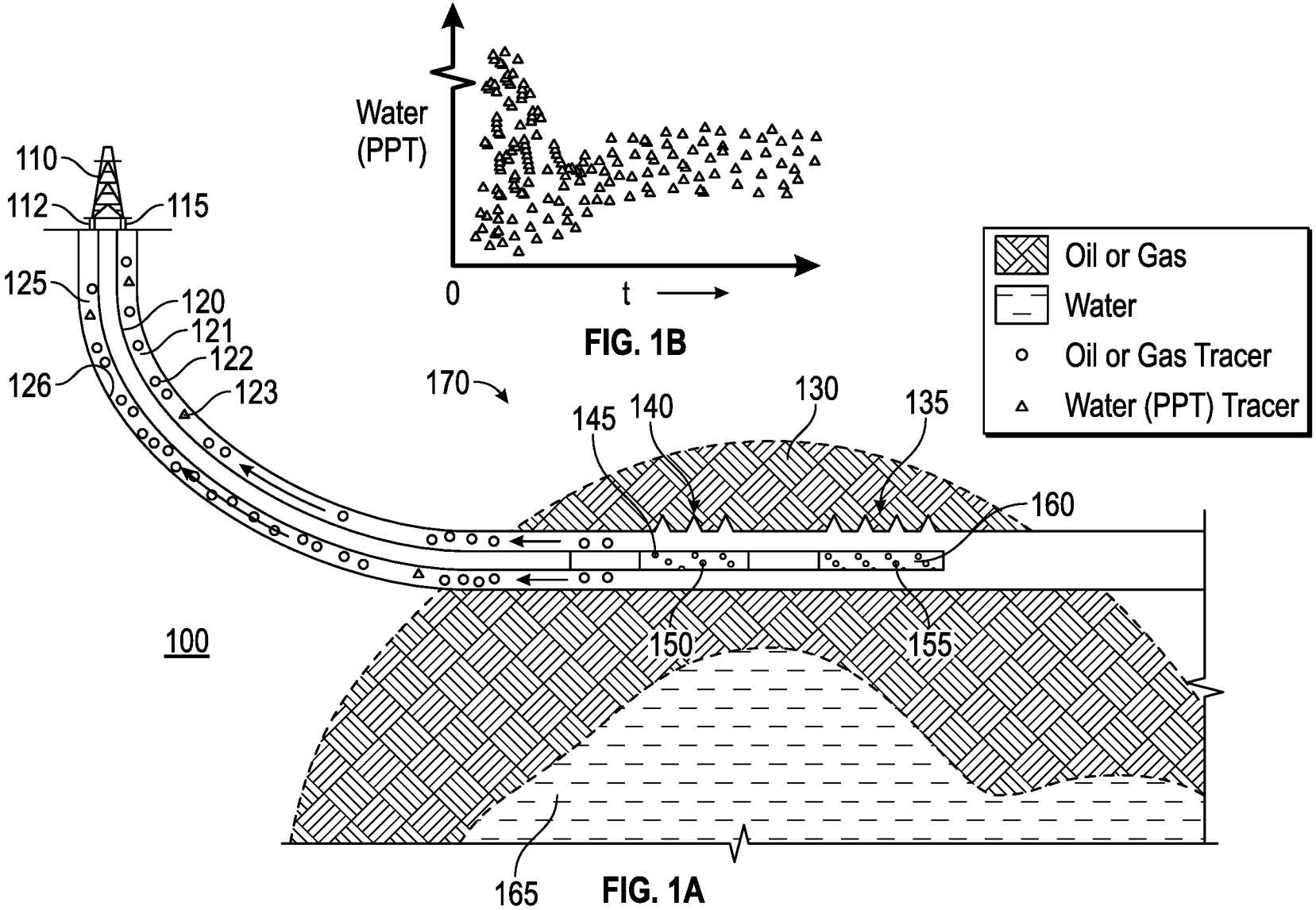
FIG. 1A depicts an exemplary oilfield environment with a perforation string inserted into a wellbore.
FIG. 1B depicts an exemplary histogram of water parts per trillion (ppt) versus time from produced fluids from a wellbore according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

In the following discussion and in the claims, the terms "including" and "comprising" are used in an open-ended fashion, and thus should be interpreted to mean "including, but not limited to . . . "

Overview

Disclosed herein is a method for monitoring a wellbore, in particular the composition, fractions and quality of the fluids produced by a wellbore over time. As disclosed herein a perforation string having one or more perforation guns can be inserted into a wellbore and activated to form perforations in the surface walls of the wellbore. Oftentimes a number of perforations are made along a plurality of intervals in a wellbore. After perforating the wellbore, rather than remove the perforation string as has been conventionally been done, the entire perforation string or a portion thereof can be left in place. Accordingly, fracturing processes and/or completion processes can be carried out while the perforation string or a portion thereof is kept in the wellbore adjacent to the wellbore perforations. For instance, production tubing may be inserted along with or above the perforation string and hydrocarbon withdrawn from the wellbore all while the perforation string is maintained and left in the wellbore. This method saves time and improves efficiency, as completion and production can be immediately carried out.

Given that the perforation string is left in the wellbore and is present during production, the perforation string can be advantageously used for additional purposes. For instance, releasable tracers can be placed at one or more locations along the perforation string which may be configured to release in the presence of certain target fluids. Moreover, the releasable tracers may be located at the perforation guns along the length of the perforation string. The releasable tracers may be embedded in various substrates such as polymeric substrates or composite substrates. The releasable tracers then flow back to the surface and are measured so as to indicate the presence and/or amount of particular fluids. The releasable tracers may target specific fluids such that they are released only in the presence of such fluids, such as hydrocarbon (which may be gas or liquid) on the one hand or water on the other. In this way, an operator may be able to determine whether the well is producing water as well as the amount of water (or the fraction of water in the fluid). Further, by using different types of tracers along the length of the perforation string, the source of the fluids in the formation or wellbore may be determined. Moreover, different types of releasable tracers may be employed at each location, each releasing in the presence of a different type of fluid, such that an operator can detect multiple types of fluids.

Accordingly, there may be a plurality of releasable tracers at each location or at each of the plurality of perforation guns along the perforation string. Further, the tracers may be placed at different locations in or near intervals that have perforations and fractures where the fluid enters the wellbore from the surrounding formation. By placing tracers with perforation guns, they are more likely to be near the fluid producing perforations. The releasable tracers may be the same or different along the length of the perforation string.

Additionally, the perforation string may be maintained downhole for a long period of time, for example many years. In this way, the fluids produced by the wellbore may be monitored over a long period of time, and the fraction of water, hydrocarbon (gas or liquid) or other fluid may be determined. Adjustments can be made in view of such determinations. For instance if the wellbore is producing amounts of water that reach a predetermined level, the well's hydrocarbon production can be slowed so as to reduce the amount of water cut due to coning. Alternatively, the location of incoming water in the wellbore may be determined and the completion equipment correspondingly manipulated to reduce or eliminate the contribution of a undesirable fluid producing zone of the formation. In a multizone completion with comingled flow, this could allow a targeted rate reduction in just the zone producing undesirable fluids, rather than reducing production in the whole well.

This can be carried out even in corrosive environments. A corrosive hostile environment (CHE) perforation gun may therefore be used which employs anti-corrosive materials. This allows the perforating string to remain intact across the perforated zone, thus permitting monitoring of the wellbore for a period of years.

DESCRIPTION

FIG. 1A provides an exemplary oilfield environment 100 which is in the production phase. As shown, a wellbore 125 passes through a subterranean formation 170. A rig 110 is provided at the entrance 112 of the wellbore 125 on the surface 115 of the earth. The rig 110 may include pumping equipment for injecting or drawing fluid from the wellbore 125. A perforation string 120 extends within the wellbore 125 from the entrance 112 of the wellbore 125. The wellbore 125 has a surface wall 126 which may be cased or uncased. As illustrated in FIG. 1A, the wellbore 125 may have a vertical portion and a horizontal portion, with the horizontal portion extending into the formation 170. The subterranean formation 170 contains hydrocarbon 130, which may be oil and/or gas. Additionally, there may be a water zone 165 contained within the formation or adjacent zones.

The perforation string 120 includes one or more perforation guns. The perforation string 120 may be or include any conveyance for deploying the perforation guns along its length, and which includes power for activating the perforation guns. The conveyance may include wireline, electric line, tubing, coiled tubing, drill pipe, slickline, and/or downhole tractor or other suitable conveyances. The conveyance itself may also serve as a production tubing, and withdrawing fluid from the formation and may have intake ports for receiving fluid from within the wellbore. The activation of the perforation guns may be electrically carried out via the conveyance, wiring, or have a local power supply. In the example illustrated in FIG. 1A, the perforation string 120 includes at its downhole end a first perforation gun 155 having charges 160, and further up the perforation string 120 a second perforation gun 150 having charges 145. As shown, perforations 135 are formed by perforation gun 155 and perforations 140 are formed by perforation gun 150. The perforations 135, 140 are formed in the surface wall 126 due to the activation and firing of the perforation guns 150, 155. The perforation guns 150, 155 may be spaced a distance from one another, such as 30 to 300 feet, or 50 to 200 feet, or 75 to 150 feet from one another so as to perforate the wellbore 125 in a plurality of intervals each separated by the same distance as between the perforation guns 150, 155. Although two perforation guns 150, 155 are shown, any number or plurality of perforation guns may be employed separated by any desired distances. After perforating, fluid may immediately flow from the formation. The wellbore 125 may be in an underbalanced configuration thereby inducing fluid production upon perforation. After perforating the surface wall 126 of the wellbore 125, hydraulic fracturing may optionally be carried out to extend the perforations 135, 140 deeper into the formation 170. The fracturing process may include a fracturing fluid which deposits a proppant into the fractures to hold the fractures open so as to facilitate the flow of fluid from the formation.

After perforation and optionally fracturing processes are complete, as shown in FIG. 1, the perforation string 120 is left in place. Alternatively, or additionally, the perforation guns 150, 155 may be severed from the conveyance or upper portion of the string 120. Production involves pumping or otherwise drawing fluid from the formation to the surface 115 of the earth. The perforation string 120 may include tubing portions for intake of fluid from the wellbore as production. For instance a fluid 121 is shown in the wellbore 125 which may be made up of a number of different fluid components, including fluids such as water and/or a hydrocarbon such as oil or gas produced from the formation. In this case no production tubing is shown, and so the fluid 121 may be drawn through the wellbore 125 to the entrance 112. The fluid 121 may include hydrocarbon from hydrocarbon 130 as one of its fluid components which is drawn from the formation 170 through the perforations 135, 140 into the wellbore 125. The fluid 121 may also include water from water zone 165 as one of its components, which may also be produced from perforations 135, 140 into the wellbore 125. The fraction or concentration of water in the fluid 121 may be very small, for example as low as 0.01 ppt or more, alternatively 0.1 ppt or more, 1.0 ppt or more.

The perforation string 120 may have releasable tracers at one or more locations along its length (released into fluid 121 as releasable tracers 122 and 123 as shown in FIG. 1A, and may be embedded into the perforation string 121 as releasable tracers 215*a*-215*d* discussed in FIG. 2 further below). The releasable tracer may be located at perforation guns 150, 155, additionally or alternatively along the perforation string 120 between the perforation guns 150, 155, additionally or alternatively, above the perforation guns along the length of the perforation string 120 to the entrance 112 at the surface 115. In order to improve effectiveness, the releasable tracers may be placed proximal to the perforations from which the reservoir fluids flow. By coupling the releasable tracers to the perforation guns 150, 155, the releasable tracers will more likely be proximate the perforations and portions of the wellbore 125 where fluid 121 will enter from the formation. In some cases when a perforation string is left in a well after use, the perforation string may be pushed or dropped to the bottom of the wellbore. Accordingly, when the releasable tracers are located at the perforation guns, such as perforation guns 150, 155, the perforation guns should be kept proximate to, i.e., close or near, the perforations, such as perforations 135, 140. The perforation guns may be kept in the same interval so as to expose the releasable tracers to fluid produced from the perforations. The releasable tracers are configured to be released from the perforation string 120 in the presence of particular target fluids. For instance, the releasable tracers may be water soluble or hydrocarbon soluble, and so may be released in the presence of fluid 121 depending on whether hydrocarbon or water is present in the fluid 121. Accordingly, upon contact of the fluid 121 with the perforation guns 150, 155 the releasable tracers may be released into the fluid to flow to the entrance 112 at the surface 115 depending on the composition of the fluid 121.

As the fluid 121 flows from perforations 135, 140 the fluid 121 may contact one or both perforation guns 150, 155 which may have the releasable tracers. As the fluid 121 contains hydrocarbons produced from hydrocarbon 130, the releasable tracers 122 which are configured to release in the presence of hydrocarbons are released into the fluid 121 to flow to the entrance 112. The releasable tracers 122 can then be measured at the surface to determine that the desired fluids, such as hydrocarbons, are indeed present along with determining their respective amounts. The amount of releasable tracers 122 can correspondingly indicate the amount of hydrocarbon in the produced fluid 121. In addition to hydrocarbon, some amount of water from water zone 165 may also flow into the wellbore 125 through the perforations 135,140, thereby making up a fraction of the fluid 121. Upon contact of water in the fluid 121 with the perforation guns 150, 155, releasable tracer 123 is released into the fluid 121 to flow toward the entrance 112. Similarly to releasable tracer 122, the presence and amount of releasable tracers 123 can detected and measured to correspondingly indicate the amount of water in the produced fluid 121. While hydrocarbon and water are used herein as examples, any other fluid may be detected as well using other types of tracers which are configured to be released in the presence of such fluids.

As illustrated in FIG. 1A, a greater number of releasable tracers 122 than releasable tracers 123 are present in the wellbore 125. While FIG. 1A is not intended to indicate precise amounts, FIG. 1A does illustrate that the releasable tracers 123, and therefore water, is present in the fluid 121 in smaller amounts than the releasable tracer 122 and hydrocarbon. The releasable tracers can be captured, measured and logged on the surface and provided, for instance, in a histogram for analysis. Shown in FIG. 1B is a histogram illustrating the fraction of water on the Y-axis in ppt versus time on the X-axis. As shown, over the life of the well, the high initial amount of water drops and then slowly rises over time.

The production of water from wells is generally undesirable, and so if the production of water or presence of water becomes too high, the efficiency and value of the fluid produced from the well is reduced. In an extreme case the water migration can choke the oil migration near the wellbore, necessitating the closing of the well. By detecting the amount of water being produced an operator can take appropriate action to improve production of hydrocarbon. Accordingly, if the amount of water or water fraction detected via the use of releasable tracers is high or at a predetermined level, the operator may carry out a number of mitigating actions, such as adjust or reduce pumping rate, or if production tubing is in the wellbore, adjust its placement.

In addition to the above, different releasable tracers may be used and placed at different locations to provide more information on the type and source of fluid. For instance, two different types of tracers may be placed at the perforation gun 155 at the end of the perforation string, one configured to release in the presence of water (therefore targeting water), and the other in the presence of hydrocarbon (therefore targeting hydrocarbons), and furthermore, another set of two different types of tracers may be placed at the perforation gun 150. Accordingly, if water or hydrocarbon is produced out of perforations 135, the fluid will contact the perforation gun 155 and release one or both releasable tracers. On the other hand, if water or hydrocarbon is produced from perforations 140, the fluid will contact perforation gun 150 and release one or both releasable tracers. These releasable tracers will flow to the surface and can be measured for the presence and relative amounts of the fluid. For instance, if the releasable tracers which were at perforation gun 155 were detected, then an operator can determine whether water or hydrocarbon is produced at perforations 135. Further, if releasable tracers which were located at perforation gun 150 are detected, then an operator can determine if water or hydrocarbons are produced at perforations 140. The releasable tracers located at perforation gun 150 may also be released due to fluid produced at perforations 135 because perforation gun 150 is upstream from such perforations 135. However, in such case given that the releasable tracers at perforation gun 155 are detected an operator can determine that the source of the fluid was perforations 135. In this way the source and interval of the fluid can be isolated.

If the presence of water reaches a predetermined level, an operator may adjust the pumping rate or adjust production tubing which may be asserted (not shown in FIG. 1). Even though two perforation intervals are illustrated in FIG. 1, these can be carried out in relation to any number of a plurality of perforation intervals. The releasable tracers herein can allow for the separation of intervals in the presence of a comingled production flow for measuring the fluids from each interval. As much as 1-500, alternatively 1-200, different releasable tracers may be used depending on the number of intervals in the wellbore and locations on the perforation string. One, two or more, or any plurality of releasable tracers may be provided at each location along the perforation string, for instance at each perforation gun or other points on the perforation string.

The releasable tracers may be employed and targeted to detect the presence, amount and source of various fluids produced from a formation, including but not limited to, water and hydrocarbon. This can inform an operator what may be occurring downhole, such as which perforations may be producing or not producing water or hydrocarbon (gas or liquid), indicating whether there is breakthrough on the surface, whether coning is occurring, and inform whether an early inflow choking decision is required, and negate costly actions such as pulling the perforation string to conduct logging, or looking for the source of coning or breakthrough behavior.

Figure 2:
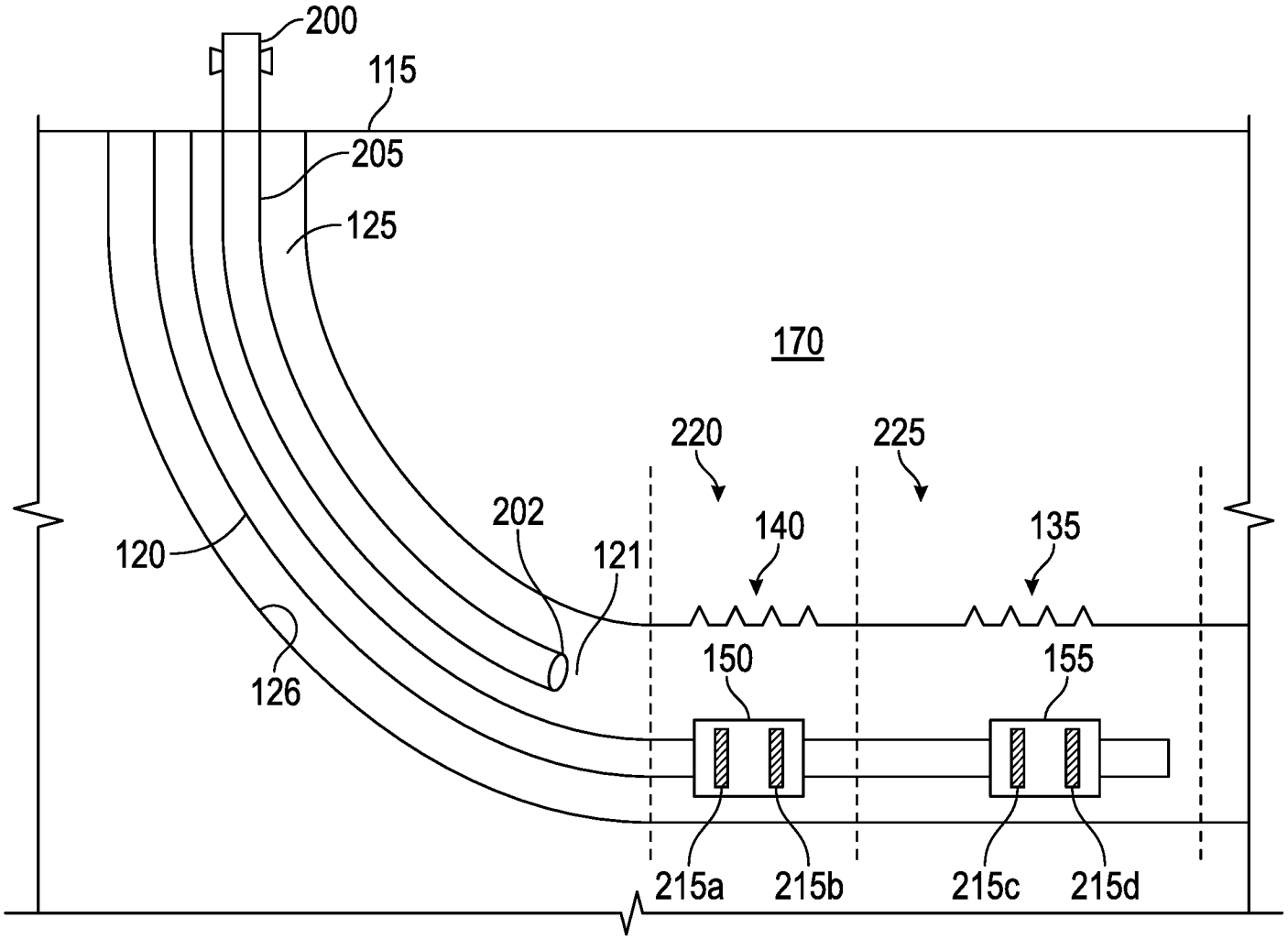
FIG. 2 depicts an exemplary oilfield environment with a perforation string inserted into a wellbore.

As Illustrated in FIG. 2, there is shown a wellbore 125 and a perforation string 120 having perforation guns 150, 155 extending in wellbore 125. Also shown in FIG. 2 is a production tubing 205 having a pump 200. The downhole end 202 of the production tubing 205 in this case is set above the perforation interval closest to the entrance of the wellbore 125 so as to receive fluid 121 produced from the formation 170. Also illustrated are perforations 140 and perforation gun 150 in interval 220, with the boundaries of interval 220 generally outlined by dashed lines. Further perforations 135 and perforation gun 155 are shown in interval 225, with the boundaries of interval 225 also generally outlined by dashed lines. Releasable tracers are located at the perforation guns 150,155. In particular, perforation gun 150 is illustrated with releasable tracers 215*a* and 215*b* coupled thereto, with 215*a* configured to release in the presence of water, and 215*b* in the presence of hydrocarbon. Additionally, perforation gun 155 is illustrated with releasable tracers 215*c* and 215*d* coupled thereto, with 215*c* configured to release in the presence of water, and 215*d* in the presence of hydrocarbon. Each of the releasable tracers 215*a*-215*d* are different from one another and can be detected separately. By using different tracers in different intervals the source of a particular target fluid can be identified.

As fluid 121 is produced from the formation 170 and drawn into the production tubing 205 the fluid may contact the perforation guns 150,155 which will release the releasable tracers 215*a*-215*d* depending on the composition of the fluid. As fluid 121 containing hydrocarbon is produced from perforations 135 and 140, and contacts the perforation gun 155, the releasable tracers 215*b* and 215*d* will be released in amounts corresponding to the amount of hydrocarbon in the fluid 121. Furthermore, as water is produced from perforations 135 it may contact the perforation gun 155, releasing releasable tracers 215*c*. At the surface, the presence and amount of releasable tracer 215*c* is measured to determine the amount of water produced from perforations 135 in interval 225. Further, the water from perforations 135 will comingle with the fluid produced from perforations 140. Despite this comingling, because the particular releasable tracer 215*c* is released from interval 225 and measured at the surface, the source of the water can be identified as being from perforations 135 in interval 225. Similarly, if water is produced from perforations 140, it may comingle with the water coming from perforations 135. This water from perforations 140 may contact the perforation gun 150 and release releasable tracers 215*a*. The releasable tracers 215*a* can be measured at the surface to determine the presence and amount of water thereby indicating the production of water from perforations 140 in interval 220. In the absence of tracers, the operator on the surface would observe a larger total amount of water, as water is produced from both perforations, without knowing from which interval the water is being produced. However, by measuring the presence and relative amounts of releasable tracers 215*a* and 215*c*, the amount of water sourced from each interval 220 and 225 can be determined.

The releasable tracers may be anything that can be configured to release in the presence of specific target fluids. Suitable releasable tracers include chemical tracers. The chemical tracers may be non-toxic and non-radioactive and may be robust in the flowpath of the production flow. They should also be differentiable and unmistakably distinctive from the other chemicals and fluids found in the wellbore and production environment. The releasable tracers may be embedded in a substrate. The releasable tracers may be in the form of rods or panels, or any shape and coupled to the perforation string at any location along its length, including one or more, or a plurality of perforation guns. The releasable tracers may be attached directly to the outside of the perforation string or perforation gun, or integrated into the body, or provided on the inside of the perforation string or perforation gun, as long as it is accessible to fluid within the wellbore. The releasable tracers can be soluble in water or hydrocarbon, or other components in the produced fluid such that the releasable tracers themselves dissolve or disperse in the wellbore fluid. Alternatively, the substrate for the releasable tracer may be dissolvable, dispersible or otherwise degradable in the presence of water or hydrocarbon, or other components in the produced fluid thereby releasing the tracer. For instance a releasable tracer may be configured to release in the presence of water by being water soluble, or a releasable tracer may be configured to release in the presence of a hydrocarbon by being hydrocarbon soluble. Alternatively, there may be sensors provided which upon detecting water or hydrocarbon, or other components in the produced fluid may release the releasable tracer. For instance the releasable tracer maybe kept in a chamber and released upon detection of specific fluids and in amounts depending on the fluids. Accordingly, the releasable tracer may be released in a multitude of ways and corresponding to a specific fluid component in the produced fluid.

The releasable tracers upon release flow with the fluid in the wellbore to the entrance of the wellbore at the surface. The presence and amount of tracers may be measured on-site or taken to a lab.

The perforation string along with its perforation guns may be left in place for a long period of time including 1-5 years. This permits passive monitoring using the releasable tracers for such period to measure the production value and quality of the fluids produced from the well.

This may also be carried out even in corrosive environments. A corrosive hostile environment (CHE) perforation gun may therefore be used which employs anti-corrosive materials. For instance strong alloys may be used which resist the harsh downhole environments, which may include corrosive chemicals and gases, high fluid velocities, and high temperatures and pressures. For instance the perforation string and perforation guns on the string may include a chrome alloy, and in particular a modified martensice chrome alloy so as to protect against corrosion and last for long periods of times including several years.

Figure 3:
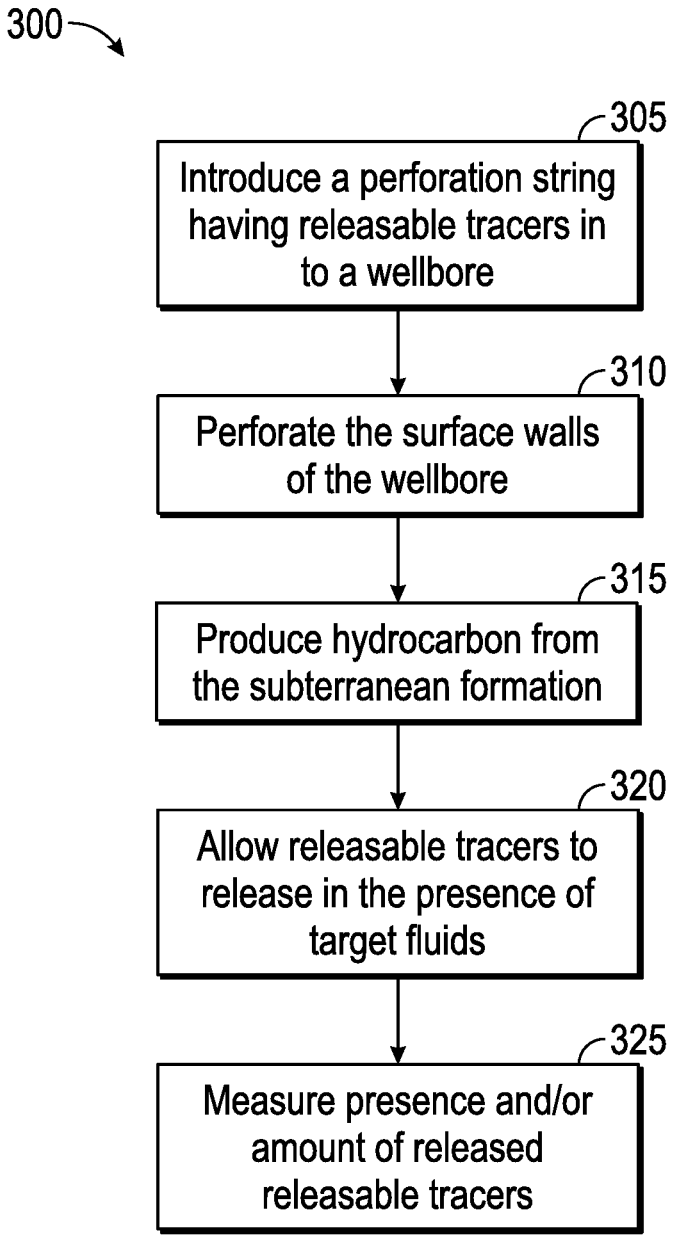
FIG. 3 is an exemplary flow diagram illustrating the passive monitoring of a wellbore as disclosed herein.

FIG. 3 provides a flow chart illustrating an exemplary method 300 for determining the presence and amounts of fluids downhole. As shown in step 305, a perforation string is introduced down a wellbore penetrating a subterranean formation which has a hydrocarbon reservoir. Next, as shown in step 310, the perforation guns on the perforation string are activated so as to perforate the surface walls of the wellbore along a plurality of intervals. Thereafter, in step 315, hydrocarbon can be produced and withdrawn from the subterranean formation. A production tubing may be inserted above the perforation closest to the entrance of the wellbore to withdraw hydrocarbon. Next, as shown in step 320, the fluid from the subterranean formation may contact the perforation string to release the releasable tracers. The releasable tracers are configured to release upon contact and in the presence of a target fluid, such as water or hydrocarbon. Then as shown in step 325, the released releasable tracers are measured to determine the presence and amount of the corresponding fluid for which they are a target for. Accordingly, an operator may determine the types and amounts of fluids downhole as well as the particular perforation and/or interval source for the fluid.

Statements of the Disclosure Include:

Statement 1: A method comprising introducing a perforation string into a wellbore passing through a subterranean formation, the perforation string having a perforation gun and a releasable tracer, the releasable tracer being releasable in response to a target fluid in a produced fluid produced from the subterranean formation contacting the perforation string; perforating, with the perforation gun, a surface of the wellbore; withdrawing the produced fluid from a wellbore; allowing the releasable tracer to release from the perforation string after the produced fluid from the subterranean formation contacts the perforation string and flow toward an entrance of the wellbore; and measuring at least one of an amount or presence of the releasable tracer thereby indicating at least one of an amount or presence of the target fluid produced from the subterranean formation.

Statement 2: The method according to Statement 1, further including wherein the releasable tracer is located at the perforation gun.

Statement 3: The method according to one of Statement 1 or Statement 2, wherein the releasable tracer proximate perforations formed from perforating the surface of the wellbore.

Statement 4: The method according to any one of the preceding Statements 1-3, wherein the target fluid is water.

Statement 5: The method according to any one of the preceding Statements 1-4, wherein the target fluid is a hydrocarbon.

Statement 6: The method according to any one of the preceding Statements 1-5, wherein the releasable tracer is provided at a plurality of locations along a length the perforation string, the releasable tracer being releasable from one or more of the plurality of locations when the target fluid contacts the one or more of the plurality of locations.

Statement 7: The method according to any one of the preceding Statements 1-6, wherein the releasable tracer is located at a first location along a length of the perforation string and a second releasable tracer is located at a second location along the length of the perforation string, the second releasable tracer being releasable in response to the target fluid contacting the perforation string, and the method further comprising measuring at least one of an amount or presence of the second releasable tracer thereby indicating at least one of an amount or presence of the target fluid produced from the subterranean formation.

Statement 8: The method according to any one of the preceding Statements 1-7, wherein the perforation string has a second releasable tracer which is releasable in response to a second target fluid in the produced fluid contacting the perforation string.

Statement 9: The method according to Statement 8, wherein the releasable tracer and the second releasable tracer are located at the perforation gun.

Statement 10: The method according to one of Statement 8 or Statement 9, wherein the target fluid is water and the second target fluid is hydrocarbon.

Statement 11: The method according to any one of the preceding Statements 8-10, wherein the releasable tracer is water soluble and the second releasable tracer is hydrocarbon soluble.

Statement 12: The method according to any one of the preceding Statements 1-11, wherein the perforation string has a plurality of perforation guns provided at a plurality of locations along a length of the perforation string.

Statement 13: The method according to Statement 12, wherein a different releasable tracer is located at each of the plurality of perforation guns, each of the different releasable tracers being releasable in response to the target fluid in the produced fluid contacting the perforation gun at which the different releasable tracer is located, and the method further comprising measuring at least one of an amount or presence of at least one of the different releasable tracers thereby indicating at least one of an amount or presence of the target fluid produced from the subterranean formation.

Statement 14: The method according to one of Statement 12 or Statement 13 further comprising perforating a plurality of intervals with the plurality of perforation guns.

Statement 15: The method according to any one of the preceding Statements 1-14, further comprising drawing the produced fluid through a production tubing.

Statement 16: The method according to any one of the preceding Statements 1-15, further comprising introducing a production tubing into the wellbore and withdrawing fluid from a wellbore, wherein the production tubing is introduced into the wellbore while a portion of the perforation string having the releasable tracer is maintained in the wellbore.

Statement 17: The method according to any one of the preceding Statements 1-16, wherein fluid is present at a concentration of 0.1 ppt or more.

Statement 18: The method according to any one of the preceding Statements 1-17, wherein perforation string is introduced into a horizontal portion of the wellbore.

Statement 19: A system comprising: a perforation string disposed in a wellbore passing through a subterranean formation, the perforation string having a perforation gun and a releasable tracer, the releasable tracer being releasable in response to a target fluid in a produced fluid produced from the subterranean formation contacting the perforation string; a production tubing disposed in the wellbore.

Statement 20: The system according to Statement 19, wherein the perforation string has a plurality of perforation guns provided at a plurality of locations along a length of the perforation string and wherein a different releasable tracer is located at each of the plurality of perforation guns, each of the different releasable tracers being releasable in response to the target fluid in the produced fluid contacting the perforation gun at which the different releasable tracer is located. Measuring at least one of an amount or presence of the releasable tracer thereby indicating at least one of an amount or presence of the target fluid produced from the subterranean formation.

The invention claimed is:

1. A method comprising:

introducing a perforation string into a wellbore passing through a subterranean formation, the perforation string having a perforation gun and a releasable tracer, the releasable tracer being releasable from the perforation string disposed in the wellbore in response to a target fluid in a produced fluid produced from the subterranean formation contacting the perforation string;

perforating, with the perforation gun, a surface of the wellbore;

withdrawing the produced fluid from a wellbore;

facilitating:

release of the releasable tracer from the perforation string disposed in the wellbore after the produced fluid from the subterranean formation including the target fluid physically contacts the perforation string while the perforation string is disposed in the wellbore; and flow of the releasable tracer from the perforation string toward an entrance of the wellbore; and measuring at least one of an amount or presence of the releasable tracer thereby indicating at least one of an amount or presence of the target fluid produced from the subterranean formation.

2. The method of claim 1, wherein the releasable tracer is located at the perforation gun.

3. The method of claim 1, wherein the releasable tracer is released proximate to perforations formed from perforating the surface of the wellbore with the perforation gun.

4. The method of claim 1, wherein the target fluid is water.

5. The method of claim 1, wherein the target fluid is a hydrocarbon.

6. The method of claim 1, wherein the releasable tracer is provided at a plurality of locations along a length the perforation string, the releasable tracer being releasable from one or more of the plurality of locations when the target fluid contacts the one or more of the plurality of locations.

7. The method of claim 1, wherein the releasable tracer is located at a first location along a length of the perforation string and a second releasable tracer is located at a second location along the length of the perforation string, the second releasable tracer being releasable in response to the target fluid contacting the perforation string, and the method further comprising measuring at least one of an amount or presence of the second releasable tracer thereby indicating at least one of an amount or presence of the target fluid produced from the subterranean formation.

8. The method of claim 1, wherein the perforation string has a second releasable tracer which is releasable in response to a second target fluid in the produced fluid contacting the perforation string.

9. The method of claim 8, wherein the releasable tracer and the second releasable tracer are located at the perforation gun.

10. The method of claim 8, wherein the target fluid is water and the second target fluid is hydrocarbon.

11. The method of claim 8, wherein the releasable tracer is water soluble and the second releasable tracer is hydrocarbon soluble.

12. The method of claim 1, wherein the perforation string has a plurality of perforation guns provided at a plurality of locations along a length of the perforation string.

13. The method of claim 12, wherein a different releasable tracer is located at each of the plurality of perforation guns, each of the different releasable tracers being releasable in response to the target fluid in the produced fluid contacting the perforation gun at which the different releasable tracer is located, and the method further comprising measuring at least one of an amount or presence of at least one of the different releasable tracers thereby indicating at least one of an amount or presence of the target fluid produced from the subterranean formation.

14. The method of claim 13 further comprising perforating a plurality of intervals with the plurality of perforation guns.

15. The method of claim 1, further comprising drawing the produced fluid through a production tubing.

16. The method of claim 1 further comprising introducing a production tubing into the wellbore and withdrawing fluid from a wellbore, wherein the production tubing is introduced into the wellbore while a portion of the perforation string having the releasable tracer is maintained in the wellbore.

17. The method of claim 1, wherein the produced fluid includes water, and the water in the produced fluid is present at a concentration of 0.1 ppt or more.

18. The method of claim 1 wherein perforation string is introduced into a horizontal portion of the wellbore.

19. A system comprising:

a perforation string disposed in a wellbore passing through a subterranean formation, the perforation string having a perforation gun and a releasable tracer, wherein:

the perforation gun is configured to create one or more perforations through a surface of the wellbore through which a produced fluid from the subterranean formation flows into the wellbore; and the releasable tracer being releasable in response to a target fluid in the produced fluid physically contacting the perforation string while the perforation string is disposed in the wellbore;

a production tubing disposed in the wellbore for facilitating flow of the releasable tracer from the perforation string toward an entrance of the wellbore, wherein at least one of an amount or presence of the releasable tracer is measureable thereby indicating at least one of an amount or presence of the target fluid produced from the subterranean formation.

20. The system of claim 19, wherein the perforation string has a plurality of perforation guns provided at a plurality of locations along a length of the perforation string and wherein a different releasable tracer is located at each of the plurality of perforation guns, each of the different releasable tracers being releasable in response to the target fluid in the produced fluid contacting the perforation gun at which the different releasable tracer is located, measuring at least one of an amount or presence of the releasable tracer thereby indicating at least one of an amount or presence of the target fluid produced from the subterranean formation.

* * * * *